United States Patent [19]

van der Marel

[11] Patent Number: 5,006,756

[45] Date of Patent: Apr. 9, 1991

[54] ALKALI METAL VAPOR DISPENSER

[75] Inventor: Cornelis van der Marel, Eindhoven, Netherlands

[73] Assignee: U.S. Philips Corporation, New York, N.Y.

[21] Appl. No.: 401,888

[22] Filed: Aug. 31, 1989

[30] Foreign Application Priority Data

Sep. 2, 1988 [NL] Netherlands ..... 8802172

[51] Int. Cl.[5] ..... H01J 17/26

[52] U.S. Cl. ..... 313/564; 445/10; 501/80; 252/512

[58] Field of Search ..... 313/554, 546, 547, 550, 313/564; 445/10; 501/80; 204/243 R; 428/402, 403; 252/512

[56] References Cited

U.S. PATENT DOCUMENTS

| | | | |
|---|---|---|---|
| 3,945,949 | 3/1976 | van Vucht et al. | 445/10 |
| 4,195,891 | 4/1980 | Hellier | 445/10 |
| 4,396,723 | 8/1983 | Temple et al. | 501/80 |

*Primary Examiner*—Donald J. Yusko
*Assistant Examiner*—Diab Hamadi
*Attorney, Agent, or Firm*—John C. Fox

[57] ABSTRACT

Alkali metal source comprises a powder of silicon or germanium grains having a shell of a compound of silicon or germanium and the alkali metal.

8 Claims, 1 Drawing Sheet

ALKALI METAL VAPOR DISPENSER

CROSS REFERENCE TO RELATED APPLICATIONS

U.S. patent application Ser. No. 07/401,887, filed Aug. 31, 1989, relates to dispensing alkali metal vapor by heating a metal carrier containing a compound of the alkali metal and silicon or germanium.

BACKGROUND OF THE INVENTION

The invention relates to a device for releasing metal vapour from a powder of an alkali metal, and also relates to a method of manufacturing such a device.

Such devices (dispensers) are used, for example in tubes comprising photocathodes (brightness intensifiers, X-ray image intensifiers) and photomultiplier tubes to deposit a thin layer of the metal, for example, on the cathode so as to decrease the work function of the electrons emitted by the cathode. This type of dispenser may also be used in display tubes comprising semiconductor cathodes.

A device of the type mentioned in the opening paragraph is described in GB No. 1,265,197 in which the powder comprises an alkali chromate such as cesium chromate. When heated the chromate powder is decomposed so that pure cesium is released.

One of the drawbacks of such a device is that the dimensions of the pulverulent grains of the chromate are so small that the powder exhibits poor flow properties, making it difficult to fill the holders in a regular manner and making it difficult to manufacture the dispensers in a reproducible manner.

A second drawback is the emission of unwanted gases during the supply of the alkali metal. Such dispensers often comprise silicon and zirconium-aluminium in addition to the chromate for binding oxygen which is released during the decomposition reaction. Zirconium-aluminum in particular emits adsorbed hydrogen and hydrocarbon gases at the decomposition temperature of the various alkali chromates (700°-800° C.). Also the envelope, which usually consists of nickel-chromium steel, emits these gases, notably carbon-containing gases; particularly the latter gases have a detrimental influence on the operation of photocathodes and semiconductor cathodes.

Moreover since, the alkali metal is supplied by decomposition temperature, the supply of the alkali metal is difficult to control or is not controllable at all.

OBJECTS AND SUMMARY OF THE INVENTION

It is an object of the invention, to provide a device of the type described in the opening paragraph which can be manufactured in a more reproducible manner.

It is a further object of the invention to provide a device in which the release of the alkali metal vapour is controllable.

Moreover, it is an object of the invention to reduce the emission of the unwanted gases in such a device as much as possible.

The invention is based on the recognition that this can be achieved by releasing the alkali metal by means of diffusion instead of by a decomposition reaction.

Furthermore, the invention is based on the recognition that such a release method can be realised by using a different type of pulverulent mixture than the chromates hitherto used.

To this end a device according to the invention is characterized in that the powder comprises grains of silicon or germanium with a shell comprising a compound of silicon or germanium and the alkali metal.

It is found that cesium diffuses from such a powder beginning at a relatively low temperature, for example, 530° C. The extent of diffusion is temperature-dependent and can therefore be satisfactorily controlled over a wide range.

The grains can be easily manufactured with a diameter in the range of 50–200 μm; the resulting powder thus has good flow characteristics so that the holders can be filled in a reproducible manner.

Moreover, since the diffusion takes place at a considerably lower temperature than the said decomposition reaction of cesium chromate, the emission of unwanted gases is also much smaller, all the more because additional mixtures such as zirconium-aluminium can now bw dispensed with.

The powder is preferably introduced into a holder which is substantially tubular and has one or more apertures (for example a slit) for the directed release of the alkali metal vapour. In this connection tubular is understood to mean any regular or irregular cross-section (triangular, square, etc.), but preferably circular.

Sodium, potassium, rubidium or cesium can be chosen as the alkali metal. Sodium and potassium are very suitable for use in, for example, brightness intensifiers and X-ray image intensifiers (comprising photocathodes), while cesium is more often used in photomultiplier tubes and (display) tubes having semiconductor cathodes.

A method of manufacturing a powder for use in such a device is characterized in that silicon or germanium powder is mixed in an inert atmosphere with liquid alkali metal and the mixture undergoes such a heat treatment that the alkali metal diffuses into the silicon or germanium.

Since the powder thus obtained is slightly hygroscopic and is usually not immediately stored in an evacuated space, the outer layer is preferably oxidized to protect the powder thus obtained from moisture adsorption.

BRIEF DESCRIPTION OF THE DRAWING

The invention will now be described in greater detail with reference to some embodiments and the drawing in which.

DESCRIPTION OF THE PREFERRED EMBODIMENT

Figure 1:
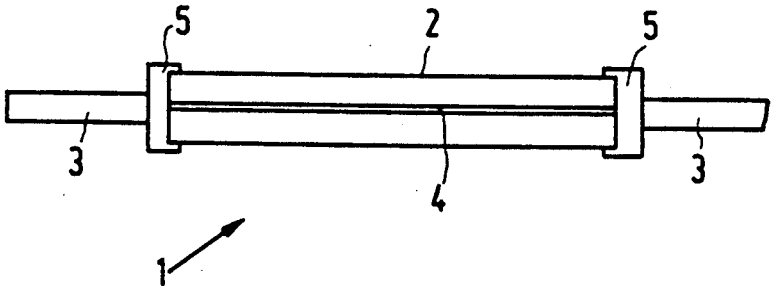
FIG. 1 shows diagrammatically a device according to the invention.

The device of FIG. 1 comprises a holder 2 which is substantially cylindrical and which is made of, for example, nickel-chromium. The holder 2 has metal caps 5 and electric terminals 3 at both of its ends for the passage of current. For a directed supply of the alkali metal vapour, the holder 2 has a slit 4.

The holder contains a powder from which an alkali metal, in this example cesium, is released upon heating. The heat treatment takes place because a current is passed through the walls of the cylindrical holder via the electric terminals 3.

The powder is obtained in this example by mixing silicon powder having a grain size of between 50 and 200 μm with cesium in an inert, e.g. argon or nitrogen, atmosphere. Pressure and temperature are such (for example, 1 atmosphere, 28° C.) that the silicon powder is in close contact with the cesium. During a subsequent temperature increase to approximately 550° C. the cesium diffuses into the silicon and forms a shell comprising a cesium-silicon compound (presumably $CsSi_4$). The rate of this diffusion process is dependent on the temperature and the thickness of the shell and the quantity of cesium.

The powder thus obtained has good flow characteristics and is very suitable for manufacturing processes in which reproducible dispenser properties are desired. For example, the grain size is very favourable for the continuous filling of chutes from which holders 2 are manufactured.

When used in a cesium dispenser, it is found that the cesium-containing powder already releases cesium in vacuo at about 530° C. upon decomposition of silicon-cesium compound and diffusion of the cesium to the surface. Since the cesium supply is determined in the first instance by this diffusion, the supply can be controlled by means of temperature.

The powder thus formed is slightly hygroscopic. It can be protected from moisture by carrying out all manufacturing steps ranging from manufacture of the device to its assembly in an electron tube or photocathode in vacuo or in an inert atmosphere. Alternatively, since in practice the powder is often stored temporarily, it is more practical to heat it in air for some time (for example 60 min. at 250° C.) to form an oxide skin to exhibit the hygroscopicity.

Instead of silicon powder, germanium powder may also be used as a starting material, while also various other alkali metals can be chosen (sodium, potassium, rubidium).

The finished powder is introduced for example into a channel-shaped strip or chute. Due to the good flow characteristics of the powder, the chute is continuously filled with a substantially constant quantity of powder per unit of length. After filling, such a chute is formed into a tube leaving a narrow slit. The tube thus obtained is separated into standard lengths whereafter the separate parts are provided with caps 5 and electric terminals 3.

The dispensers may be used in photocathodes for brightness intensifiers and X-ray image intensifiers, in photomultiplier tubes and to provide a low work function layer (particularly cesium) on semiconductor cathodes for electron tubes.

I claim:

1. A device for releasing metal vapour of an alkali metal comprising a holder containing a powder of pulverulent particles from which the alkali metal is released upon heating, characterized in that the powder comprises grains of silicon or germanium with a shell of a compound of silicon or germanium and the alkali metal.

2. A device as claimed in claim 1, in which the holder is substantially tubular and has a slit for releasing the alkali metal.

3. A device as claimed in claim 2, in which the holder is made of metal and its end are provided with terminals for the passage of current.

4. A device as claimed in claim 1, in which the alkali metal belongs to the group of sodium, potassium, rubidium and cesium.

5. A device as claimed in claim 3, in which the holder metal consists of nickel-chromium steel.

6. A device as claimed in claim 1, in which the diameter of the pulverulent particles is at least 50 μm and at most 200 μm.

7. A method of manufacturing a powder for use in a device for releasing metal vapour of an alkali metal, characterized in that grains of silicon or germanium are mixed in an inert atmosphere with liquid alkali metal, and the mixture is heated, diffusing the alkali metal into the silicon or germanium powder, thereby forming shells of silicon compound or germanium compound and the alkali metal.

8. A method as claimed in claim 7, in which the outer layer of the grains is oxidized after the diffusion.

* * * * *